United States Patent [19]

Klawitter

[11] Patent Number: 4,507,097

[45] Date of Patent: Mar. 26, 1985

[54] TOY ASSEMBLY

[75] Inventor: Ronald R. Klawitter, Hermann, Mo.

[73] Assignee: Handi-Pac, Inc., Hermann, Mo.

[21] Appl. No.: 450,019

[22] Filed: Dec. 15, 1982

[51] Int. Cl.[3] ..... A63H 1/00

[52] U.S. Cl. ..... 446/236; 446/243; 446/266; 446/484

[58] Field of Search ..... 46/204, 205, 39, 45, 46/248, 14; 15/145; 200/153 M, 340

[56] References Cited

U.S. PATENT DOCUMENTS

| | | | |
|---|---|---|---|
| 2,117,066 | 5/1938 | Liverance, Jr. | 200/153 M |
| 2,205,535 | 6/1940 | Muckenhirn | 15/145 |
| 2,370,532 | 2/1945 | Gerlache | 46/107 |
| 2,511,955 | 6/1950 | West | 200/153 M |
| 2,781,609 | 2/1957 | Allen | 46/39 |
| 3,253,365 | 5/1966 | Calderon | 46/248 X |
| 3,292,300 | 12/1966 | Lescher et al. | 46/39 |
| 3,944,760 | 3/1976 | Zdanys et al. | 200/153 M X |
| 4,155,140 | 5/1979 | Janseen et al. | 15/145 X |

FOREIGN PATENT DOCUMENTS

| | | | |
|---|---|---|---|
| 636706 | 12/1934 | Fed. Rep. of Germany | 15/145 |

OTHER PUBLICATIONS

*Kusan Toycrafts*, 1966.

*Primary Examiner*—Robert A. Hafer
*Assistant Examiner*—Daniel Nolan
*Attorney, Agent, or Firm*—Polster, Polster and Lucchesi

[57] ABSTRACT

A toy assembly which is battery operated to provide a moving design pattern which is visually enhanced by a transparent cover of varying density, the assembly including a unique actuating and interrupting switch arrangement and a unique coupling arrangement for several of the parts.

4 Claims, 4 Drawing Figures

1
67
68
66
69
71
8
7
9
4
11
6
3
2
12
13
18
14
17
78
76
77
24
22
23
29
27
16
26
21
49
47
48

TOY ASSEMBLY

BACKGROUND OF THE INVENTION

The present invention relates to a toy assembly and more particularly to a battery operated decorative toy assembly including a novel switch construction, a novel movable vane simulator arrangement providing a unique decorative pattern, and a novel construction arrangement for assemblage of several parts of a toy.

The present invention can be effectively utilized with push-pull toys of the type which incorporate rotating members to create decorative patterns and teaches a unique structure for creating attractive visual patterns of interest to children of all ages.

The novel toy assembly of the present invention permits a straightforward and economical manufacture and assembly with a minimum of parts and material to provide a toy which is light in weight to be hand manipulatable and operable by a small child with a minimum of effort and skill and yet provides a child with a toy which is visually attractive, educational and readily operable, serving as a simple introduction into the world of battery operated structures.

BRIEF SUMMARY OF THE INVENTION

In accordance with this invention, generally stated, a toy assembly is provided comprising a housing member; a motor mounted on the housing member having a drive shaft extending therefrom; vane simulator means connected to the drive shaft to be driven thereby, at least a portion of the vane simulator means being disposed relative the housing to extend beyond the periphery thereof so as to be visible relative thereto; electric power means to drive the motor mounted on the housing member; and an electrical circuit connecting the power means to the motor, the circuit including switching means mounted on the housing responsive to "closed" circuit position when the toy is placed into pressing contact with an opposing surface whereby the vane simulator means is driven with the visible portion thereof creating a visually decorative moving pattern. The vane simulator means preferably has a decorative vane simulating pattern on it, a transparent cover, secured to the housing, extends over the vane simulator means, and the cover has areas of varying thickness or density so as to enhance the visual effect of the moving pattern beneath it, the vane simulator means being moved reciprocably.

It is to be understood that various changes can be made in the arrangement, construction and form of the several parts of the toy assembly disclosed herein without departing from the scope or spirit of the present invention. For example, the embodiment presented is in the form of the popular line type lawn trimmer-weeder but the novel structure, assembly, optical and motion relationships of the vane arrangement can be used in other toy constructions such as those for helicopters, merry-go-rounds and sparklers. Furthermore the novel coupling construction of several parts as taught by the present invention could be used in any one of a number of toy assemblies, as could the unique switch assembly taught herein. For example, the coupling arrangement could be utilized in toy building blocks and the switch assembly for battery operated lamps and flash signalers.

DESCRIPTION OF THE DRAWING

Referring to the drawing which discloses one advantageous embodiment of the present invention.

DETAILED DESCRIPTION

Figure 1:
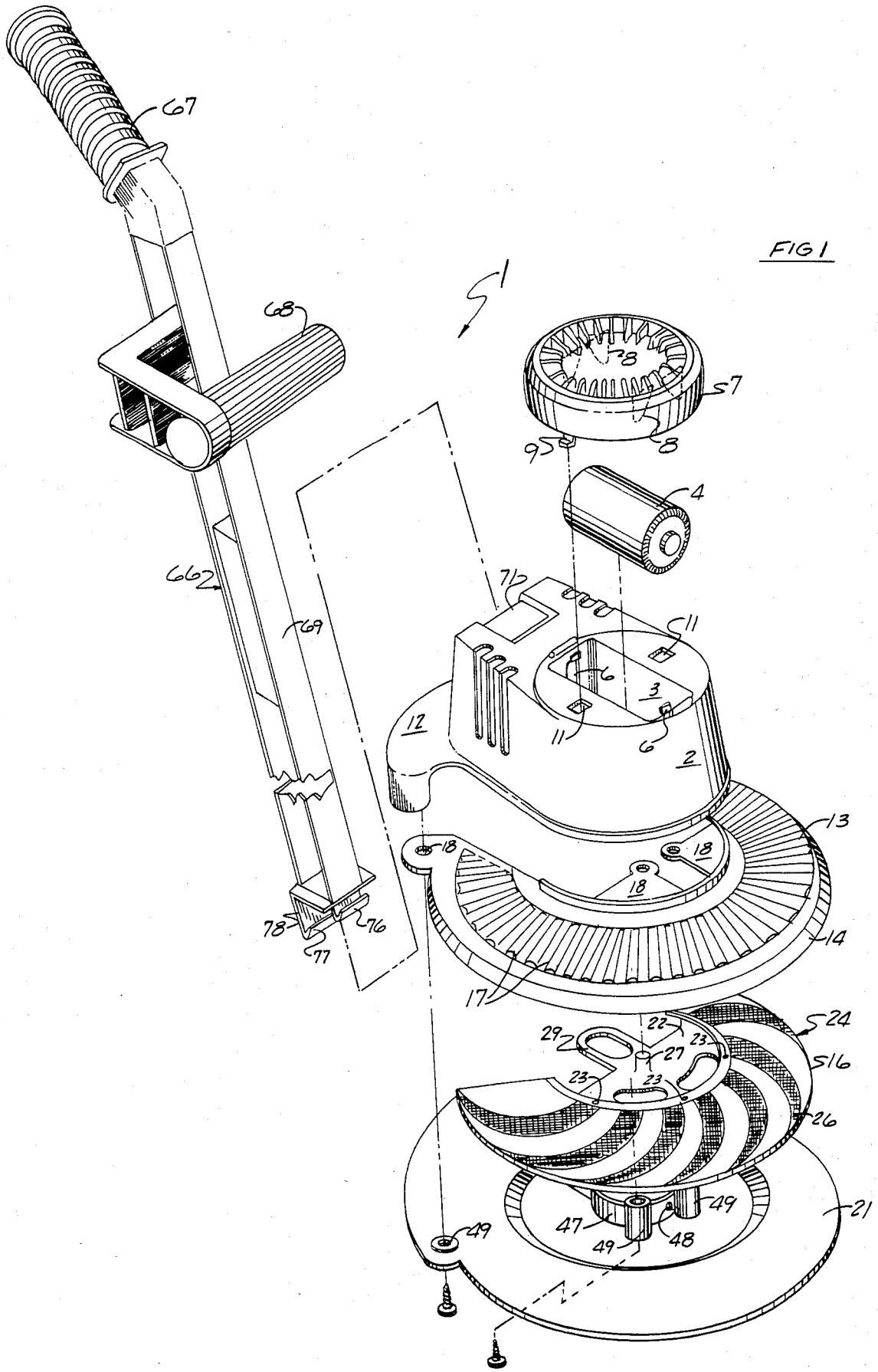
FIG. 1 is a partially broken away, exploded isometric view of the novel toy assembly taken from the top of the assembly.

As can be seen in FIG. 1 of the drawings the overall assembly embodying the present invention is in the form of a battery powered line type trimmer toy 1, including a simulated motor housing 2, and a battery receptacle 3 formed within housing 2 in substantially horizontal position to nestingly receive a storage battery 4 to engage with opposed flexible electrical contacts 6 fastened at either end of receptacle 3. A battery cover cap 7 contoured as part of the simulated motor housing is provided to cover and hold the battery in position. To accomplish this, the underside of cap 7 is provided with V-shaped wedges 8, and suitable snap lugs 9 are also provided, integral with the cover 7 and depending therefrom on either side of the battery receptacle to engage with lug receiving apertures 11 appropriately positioned in the roof of housing 11, the wedges 8 holding battery 4 in firm electrical contact position when the cover cap 7 is snapped into place. It is to be understood that the overall assembly can be made from any one of a number of suitable materials or combinations thereof and, in the instant embodiment, advantagaeously can be formed from several pieces and materials to produce selected molded plastic parts, at least a portion of which are transparent and a portion of which are yieldable or flexible, all for reasons set forth hereinafter.

It is to be noted in FIG. 1, that housing 2 is provided along a portion only of its lower periphery with an integral hood 12 to simulate a lawn trimmer, the major portion of the lower periphery being free of the hood to receive a transparent vane simulator cover 13. Vane simulator cover 13 is provided with an integral downwardly extending peripheral lip 14 which serves as a vane simulator guard for a motor driven vane simulator member 16 described hereinafter. Advantageously vane simulator cover 13 is of transparent plastic material and includes spaced radially extending lands and raised rib portions 17 to provide transparent areas of varying density to enhance the optical illusion created when the motor driven vane simulator member 16 is moved in the manner described hereinafter. Vane simulator cover 13 can be formed with suitable apertured lug portions 18 which are appropriately spaced to engage with spaced apertured screw receiving posts 19 (FIG. 2) integral with and extending downwardly from the underside of housing 2. This arrangement provides for the mounting of vane simulator cover 13 and an apertured bottom cover 21 described hereinafter.

Vane simulator member 16 includes a flat substantially semicircular disc 22 having spaced hot-headable support pins 23 extending normally from the face thereof along the outer periphery of the disc. Pins 23 pass through suitably spaced apertures along the inner periphery of a flat annular vane simulating pattern member 24 and are headed so that the pattern member can be fastened to the disc, providing a portion of the vane simulator which extends beyond housing 2 to be visible relative the housing. The pattern member, which can be made of any one of a number of suitable stiff yielding materials, advantageously is inexpensively made of carboard, permitting a ready interchange of designs by the manufacturer. In the embodiment disclosed, pattern member 24 is painted with a design comprised of a plurality of spaced radially outwardly spirally sloping lines 26 to represent blades or vanes on vane simulator 16, thus providing a visible, decorative pattern. Integral with and projecting upwardly from a flat side of disc 22 at the center of generation of the pattern member is an apertured collar 27. Collar 27 is sized to mount pivotably on post 28 (FIG. 2) to permit disc 22 to be moved thereabout.

To accomplish the pivoting motion of disc 22, an elongated slotted arm 29 extends integrally from an edge of disc 22 to be engaged by a cam 31 (FIG. 2) which extends through and engages with the wall surface defining the slot of arm 29. Cam 31 is mounted on drive shaft 32 of a small electric motor 33 mounted in a motor receptacle integral with housing 2 and extending vertically downward from battery receptacle 3.

Figure 2:
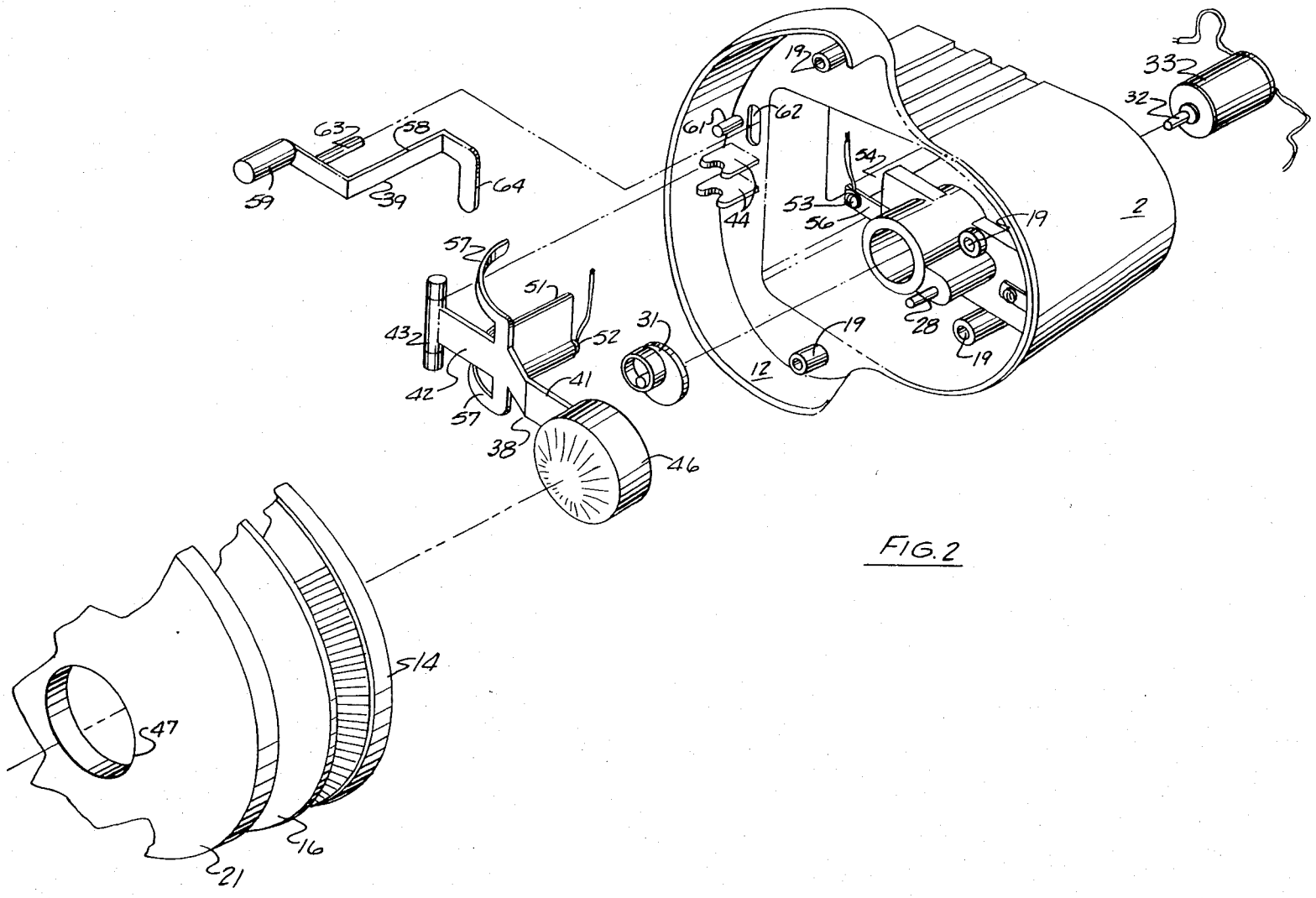
FIG. 2 is a partially broken away, exploded isometric view of the toy assembly of FIG. 1, taken from the bottom of the assembly.
Figure 3:
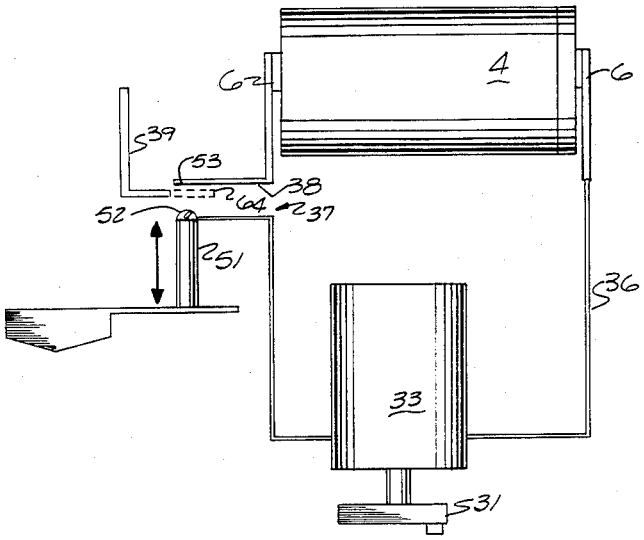
FIG. 3 is a schematic view of the electrical circuitry and switching arrangement of the present invention.

As can be seen in FIG. 3, storage battery 4 is connected to motor 33 through the opposed contacts 6 in battery receptacle 3, all of which serve to form part of an electrical circuit 36. Circuit 36 includes a switch arrangement broadly designated by reference numeral 37 and which is comprised of two switches 38 and 39. Referring to FIG. 2, switch 38, which advantageously can be made of a suitable plastic material with a certain amount of flexibility, includes an elongated arm 41 divided at one end to prove a three tine fork with the intermediate tine 42 having a barrel end 43 adapted to snap fit at its extremities into slotted, spaced support posts 44 depending downwardly from hood 12 of housing 2 (FIG. 2) to permit pivotal movement of arm 41 about such support. Integral with the other extemity of arm 41 is an actuation button 46, the button 46 being provided with a semi-spherical contact surface so as to make substantially point contact with an opposing surface, such as a floor, when the housing is set on such a surface. As can be seen in FIGS. 1 and 2, when switch 38 is in assembled position, button 46 is sized to extend through, slidably but closely, a collared aperture 47 in bottom cover plate 21, the semi-spherical surface projecting through the plate to make contact with an opposing surface. A suitable set screw 48 can be mounted in the wall of collar 47 to limit and control the stroke of button 46. Appropriately sized and spaced apertured mounting posts 49 are provided in bottom cover 21, posts 49 matingly cooperating with posts 19 in housing 2 to permit screw assembly of bottom cover 21 to the underside of housing 2. Extending integral with and intermediate the extremities of arm 41 substantially normal thereto is contact support post 51 having fixed thereto at its extremity electrically conductive contact 52. As can be seen in FIG. 2, contact 52 is part of circuit 36 and is positioned to close circuit 36 when it engages contact 53 mounted on post 54 extending integral with and downwardly within housing 2. Contact 53 in turn is connected to the other of contacts 6 in battery receptacle 3 by means of conductor 56. To urge the contacts into "open" position or, in other words, to bias switch 38 to "open," the outer tines 57 are shaped to resiliently engage against the inner wall of housing 2 adjacent pivot supports 44 to separate contacts 52 and 53 when the opposed pressure on actuating button 46 is removed. Switch 39 serves as a circuit interrupting switch and can be made from a suitable insulating moldable plastic material. As can be seen in FIG. 2 it includes a right angle arm 58 having an apertured collar 59 arranged to pivotally engage support post 61. Post 61 is positioned to extend down from hood 12 adjacent a slot 62 in hood 12, the slot serving to permit lever 63 to pass therethrough for manual movement of switch 39 to "on" or "off" position. When moved to "off" position insulator tab 64 is caused to be positioned between contacts 52 and 53 to interrupt circuit 36.

Figure 4:
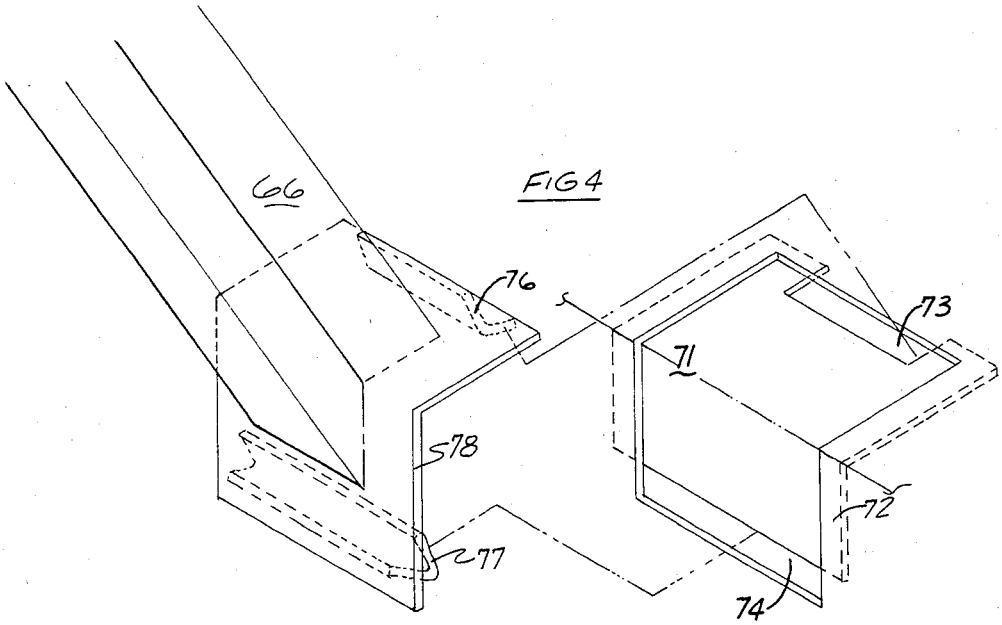
FIG. 4 is an enlarged, partially broken away exploded isometric view of the novel coupling arrrangement utilized to join the propelling rod to the housing of the toy assembly disclosed.

Referring to FIGS. 1 and 2 of the drawings, a propelling rod member 66 is disclosed. Rod 66 can also be made from any one of a number of suitable moldable, somewhat flexible, plastic materials. It is shaped in the embodiment disclosed to include a grip handle 67 at one extremity thereof and a guide handle 68 immediately therebelow to simulate a commercial trimmer. Suitable ribs 69 can be molded into propelling rod 66 to give the rod structural strength. At the other extremity of rod 66 a unique assembly coupling arrangement, as shown in FIG. 4, is provided to couple rod 66 to housing 2. To accomplish this coupling, housing 2 is cut away at the roof and side adjacent thereto to provide slot 71. Extending across slot 71 with its legs fastened to the roof and adjacent side of housing 2 respectively is a right angle structural member 72. Member 72 is so sized and shaped relative slot 71 as to provide suitably sized elongated apertures 73 and 74. Apertures 73 and 74 serve to nestingly receive in snug engagement therewith detents 76 and 77 which are integral with the extremities of right angle member 78 fixed to the end of rod 66 and sized to conform with slot 71 and right angle member 72. It is to be noted that detent 76 can be in the shape of an angled bar. On the other hand, detent 77 is of flexible U-shaped cross-section to provide a lip member compressible for passage through elongated slot 74 to resiliently grip inner wall of housing 2 and, because of the irregular contour of the facing right angle members 72 and 78 on the housing 2 and rod 66 respectively, to hold rod 66 firmly in position on housing 2.

It is to be understood that various changes can be made by one skilled in the art in the several parts of the novel apparatus disclosed without departing from the scope or spirit of the present invention. For example, the member 24 can be provided with a design other than blades 26 and the variable density lines 17 on vane 16 can be of different forms of lenses to provide different optical illusions. Equally, other motions can be imparted to the vane than the pivotal reciprocating motion disclosed. The switch 38 that is closed automatically when the device is placed on a flat surface produces an attractive result, but it can be replaced by a switch in or on the handle or elsewhere, or a rod in the handle, for example, extending to the housing to actuate a switch there. Likewise, the on-off switch 39 now mounted with an arm projecting through a slot in the hood 12 can be omitted or relocated, although its preferred location permits the use of short leads and requires a conscious effort to close, so as to lessen the chance of accidental closing of the circuit. These are merely illustrative.

I claim:

1. A toy comprising a housing member; a motor mounted on said housing member having a drive shaft extending therefrom; vane member means connected to said drive shaft to be driven thereby, at least a portion of said vane member means being disposed relative said housing to extend beyond the periphery thereof so as to be visible relative thereto; electric power means to drive said motor mounted on said housing member; an electrical circuit connecting said power means to said motor, said circuit including switching means comprising a first switch member mounted on said housing, normally biased to open position and adapted to be moved against said bias, when said toy is placed into pressing contact with an opposing surface, to closed position to complete said electrical circuit whereby said vane member means mounted on said drive shaft of said motor is driven with the visible portion thereof creating a visually decorative moving pattern, said switching means including a flexible arm member split at one end in at least two parts, one of which parts is pivotally mounted to said housing and the other of which is arranged to resiliently engage against said housing; an actuating button fixed to the other end of said arm member; a first contact member fixed to said arm member, said first contact member being connected to one side of said electrical circuit which connects said power means to said motor; a second contact member fixed to said housing, said second contact member being connected to a second side of said electrical circuit and being so positioned to engage with said first contact member when said actuating button on said arm member is pressed into contact with an opposing surface to close said circuit, said contacts being caused to separate by said resiliently engaging part of said arm member which biases said contacts to "open" position when the pressure on said actuating button against the opposed surface is released.

2. A toy comprising a housing member; a motor mounted on said housing member having a drive shaft extending therefrom; vane member means connected to said drive shaft to be driven thereby, at least a portion of said vane member means being disposed relative said housing to extend beyond the periphery thereof so as to be visible relative thereto; electric power means to drive said motor mounted on said housing member; an electrical circuit connecting said power means to said motor, said circuit including switching means comprising a first switch member mounted on said housing, normally biased to open position and adapted to be moved against said bias, when said toy is placed into pressing contact with an opposing surface, to closed position to complete said electrical circuit whereby said vane member means mounted on said drive shaft of said motor is driven with the visible portion thereof creating a visually decorative moving pattern, said switching means including a first flexible arm member split at one end to provide a three tined fork with the intermediate tine being pivotally mounted to said housing and the other tines being arranged to resiliently engage against said housing; an actuating button fixed to the other end of said first arm member, a first contact member fixed to said first arm member, said first contact member being connected to one side of said electrical circuit which connects said power means to said motor; a second contact member fixed to said housing, said second contact member being connected to a second side of said electrical circuit and being so positioned as to engage with said first contact member when said actuating button on said first arm member is pressed into contact with an opposing surface to close said circuit, said contacts being caused to separate by said resiliently wall engaging tine members on said first arm member which biases said contacts to "open" position when the pressure on said actuating button against the opposed surface is released; and a second arm member pivotally mounted at one end to said housing and having the other end contured to move into and out of circuit interrupting position between said first and second contacts on said first arm member; said second arm member having a lever actuating member connected thereto to permit manual pivotal movement of said arm.

3. A toy comprising a housing member; a motor mounted on said housing member having a drive shaft extending therefrom; vane member means connected to said drive shaft to be driven thereby, at least a portion of said vane member means being disposed relative said housing to extend beyond the periphery thereof so as to be visible relative thereto; electric power means to drive said motor mounted on said housing member; an electrical circuit connecting said power means to said motor, said circuit including switching means comprising a first switch member mounted on said housing, normally biased to open position and adapted to be moved against said bias, when said toy is placed into pressing contact with an opposing surface, to closed position to complete said electrical circuit whereby said vane member means mounted on said drive shaft of said motor is driven with the visible portion thereof creating a visually decorative moving pattern, said vane member means including a flat substantially semicircular disc member having spaced support pin members extending normally from the face thereof and a flat annular decorative pattern member having apertures along the inner periphery thereof to engage said support pins of said disc member for fastening thereto to provide the portion of said vane member means visible relative said housing, said disc member including an apertured collar, a pivot post on said housing spaced from the drive shaft of said motor on said housing to receive the apertured collar of said disc member to permit pivotal movement thereabout, said disc member having an elongated slotted arm member extending from the flat side thereof; cam means mounted on the drive shaft of said motor and positioned to engage with the slotted arm of said disc member to provide pivitol reciprocating motion thereto along with the annular pattern member fixed thereon, and a transparent cover for said decorative pattern member fixed to said housing, said cover having areas of varying density to enhance the optical illusion created when said annular pattern portion is pivotally reciprocated.

4. A molded plastic push-pull mower toy comprising a mower housing having a battery receptacle integral therewith with spaced opposed flexible electrical contacts disposed at opposite ends thereof to nestingly contact opposite ends of a small electric storage battery when positioned therein; a motor receptical integral with said housing to extend vertically downward therein; a motor having a drive shaft mounted in said motor receptacle; a storage battery mounted in said battery receptacle with opposite ends thereof engaging the opposed flexible contacts; one of said opposed electrical contacts in said storage battery being connected to one side of said motor; a first switch means including an elongated first arm member divided at one end to provide a three tined fork with the intermediate tine being pivotally mounted at its end to the inner wall of said housing and the outer tines resiliently engaging against said inner housing wall; an actuating button having a semi-spherical contact surface integral with the other end of said first arm member; a contact post extending normally from said first arm member intermediate its ends; a first contact member positioned at the extremity of said contact post, said first contact member being electrically connected to the other side of said motor; a second contact member fixed to said housing, said second contact member being electrically connected to the other flexible contact in said storage battery receptacle and being so positioned as to engage with said first contact member when said actuating button on said first arm member is pressed into contact with an opposing surface to close said circuit, said contacts being caused to separate by said resiliently wall engaging tine members on said first arm member which biases said contacts to "open" position when the pressure on said actuating button against the opposed surface is released; a second arm member having a collar at one end; a downwardly projecting post on said housing to pivotally receive said collar on said second arm member; an actuating lever extending from said second arm member; an elongated slot in said housing through which said actuating lever passes to permit manual movement thereof and pivotal movement of said second arm member, said second arm member being geometrically contoured and positioned so that the end opposite said pivot end can be moved into and out of circuit interrupting position between said first and second contacts on said first arm member; van member means including a flat substantially semi-circular disc member having spaced support pin members extending normally from the face thereof; a flat annular pattern member having apertures along the inner periphery thereof to engage said pins of said disc member for fastening thereto to provide a portion of said vane member means visible relative said housing, said pattern member having a plurality of spaced radially extending spirally disposed sloping lines on an upper surface thereof to provide a visibly decorative pattern thereon, said disc member including an apertured collar thereon; a downwardly extending pivot post on said housing spaced from said drive shaft of said motor to receive said apertured collar of said disc member to permit pivotal movement thereabout; said disc member having an elongated slotted arm member extending from an edge wall thereof; cam means mounted on the drive shaft of said motor positioned to engage with the slotted arm of said disc member to provide pivotal reciprocating motion thereto along with said pattern member fixed thereon; a transparent vane cover for said decorative pattern member fixed to said housing, said cover having radially extending spaced vane portions thereon to provide transparent areas of varying density to enhance the optical illusion created when said annular pattern portion with the spirally sloping lines is pivotally reciprocated therebelow; a pair of spaced parallel elongated slots disposed in the roof and side wall of said housing; a substantially rigid propelling rod member contoured at one end to provide a manual grip and contoured at the other end to conform with said housing between said elongated slots in said roof and side wall and including spaced elongated detent members sized and spaced to snugly nest with said elongated slots, with one of said detent members being of flexible U-shaped cross-section to provide a lip extremity compressible for passage through said slot to resiliently grip the inner wall of said housing; an apertured bottom plate member fixed to said housing with the semi-spherical contact surface of said actuating button on said first switch arm member extending through the aperture therein to permit pressing contact with an opposing surface.

* * * * *